US006419769B1

(12) United States Patent
Lee et al.

(10) Patent No.: US 6,419,769 B1
(45) Date of Patent: Jul. 16, 2002

(54) ALUMINUM-SILICON ALLOY HAVING IMPROVED PROPERTIES AT ELEVATED TEMPERATURES AND PROCESS FOR PRODUCING CAST ARTICLES THEREFROM

(75) Inventors: Jonathan A. Lee, Madison; Po-Shou Chen, Huntsville, both of AL (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 09/749,503

(22) Filed: Dec. 22, 2000

Related U.S. Application Data

(63) Continuation-in-part of application No. 09/322,713, filed on May 25, 1999, now abandoned, which is a continuation-in-part of application No. 09/152,469, filed on Sep. 8, 1998, now abandoned.

(51) Int. Cl.[7] ..... C22F 1/04
(52) U.S. Cl. ..... 148/552; 148/698; 148/439
(58) Field of Search ..... 148/552, 598, 148/439

(56) References Cited

U.S. PATENT DOCUMENTS 3,765,877 A * 10/1973 Sperry et al. ..... 75/142
4,789,607 A * 12/1988 Fujita et al. ..... 428/653
5,922,147 A * 7/1999 Valtierra-Gallardo et al. ..... 148/549

FOREIGN PATENT DOCUMENTS

GB 2300198 * 10/1996

OTHER PUBLICATIONS

Mielke, Steffens, Beer, Henning; New Aluminum Piston Alloy with Increased Fatigue Strength at High Temperatures; SAE Internatioal The Engineering Society for Advancign Mobility Land Sea Air and Space; Feb. 23–26, 1998; pp. 41–45; 980687; Society of Automitve Engineers, Inc.; Warrendale, PA. USA...

(List continued on next page.)

*Primary Examiner*—Sikyin Ip
(74) *Attorney, Agent, or Firm*—James J. McGroary

(57) ABSTRACT

A process for making a cast article from an aluminum alloy includes first casting an article from an alloy having the following composition, in weight percent:

| | |
|---|---|
| Silicon | 11.0–14.0 |
| Copper | 5.6–8.0 |
| Iron | 0–0.8 |
| Magnesium | 0.5–1.5 |
| Nickel | 0.05–0.9 |
| Manganese | 0–1.0 |
| Titanium | 0.05–1.2 |
| Zirconium | 0.12–1.2 |
| Vanadium | 0.05–1.2 |
| Zinc | 0.05–0.9 |
| Strontium | 0.001–0.1 |
| Aluminum | balance |

In this alloy the ration of silicon:magnesium is 10–25, and the ratio of copper:magnesium is 4–15. After an article is cast from the alloy, the cast article is aged at a temperature within the range of 400° F. to 500° F. for a time period within the range of four to 16 hours. It has been found especially advantageous if the cast article is first exposed to a solutionizing step prior to the aging step. This solutionizing step is carried out by exposing the cast article to a temperature within the range of 900° F. to 1000° F. for a time period of fifteen minutes to four hours. It has also been found to be especially advantageous if the solutionizing step is followed directly with a quenching step, wherein the cast article is quenched in a quenching medium such as water at a temperature within the range of 120° F. to 300° F. The resulting cast article is suitable in a number of high temperature applications, such as heavy-duty pistons for internal combustion engines.

8 Claims, 1 Drawing Sheet

OTHER PUBLICATIONS

J.A. Taylor, G.B. Schaffer, D.H. St John; The Effect of Iron Content on the Formation of Porosityand Shrinkage Defects in Al–Si–Cu–Mg.

Alloy Casting; Solidification Processing 1997 Proceedings of the 4th Decennial International Conference on Solidification Processing; Jul. 7–10, 1997; Ranmoor House, University of Scheffield, UK...

Hatch, John E.; Constitution of Alloys; Aluminum properties and physical Metallurgy; 1984; pp. 25–27; Chapter 2; American SociEty for Metals, Metals Park, OH; USA...

Hatch, John E., Properties and Physical Metallurgy, Specific alloying Elements and Impurities; Aluminum properties and Physical Metallurgy; 1984; pp. 224–229; American Society for Metals; Metals Park, OH; USA...

W. Kowbel, V. Chellappa, J. C. Withers; Applications of Net–Shape Molded Carbon–Carbon Compositeis in IC Engines; Journal of Advanced Materials; Jul. 1996, pp. 2–7; vol. 27 No. 4; USA...

A.J. Shakesheff, P.D. Pitcher; Elevated temperature performance of particuute Reinforced Aluminium Alloys; Materials Science Forum, Proceedings of the 5th International Conf. ICAA5, July 1–5, 1996, pp. 1133–1138; vols. 217–222; 1996 Trastec publications Switzerland...

Rohatgi, Prodeep; Cast Aluminum–Matrix Composites for Automotive applications; JOM the journal of the minerals metals & Materials Society; Apr. 1991; pp. 10–15.

R.R. Bowles; D.L. Mancini, M.W. Toaz; Metal Matrix Composites Aid Piston Manufacture; CIM Technology, manufacturing Engineering; May, 1987; pp. 61–62...

* cited by examiner

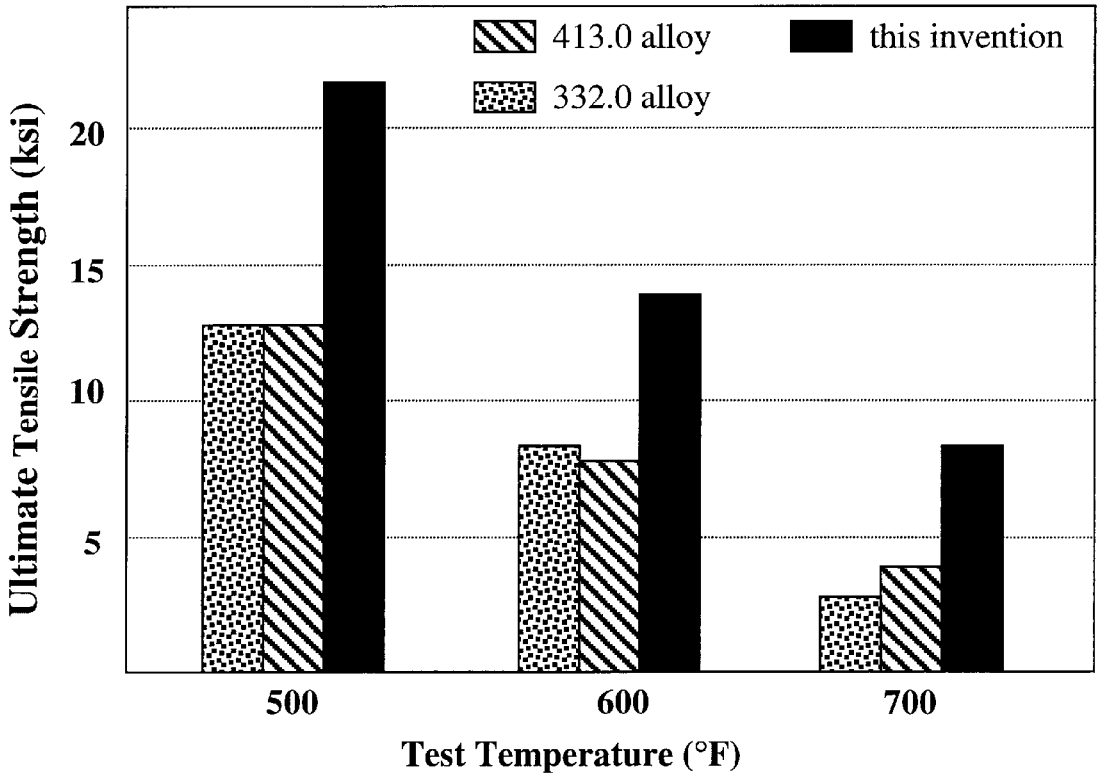
413.0 alloy
this invention
332.0 alloy
Ultimate Tensile Strength (ksi)
20
15
10
5
500
600
700
Test Temperature (°F)

ALUMINUM-SILICON ALLOY HAVING IMPROVED PROPERTIES AT ELEVATED TEMPERATURES AND PROCESS FOR PRODUCING CAST ARTICLES THEREFROM

RELATED APPLICATIONS

This application is a continuation-in-part of application Ser. No. 09/322,713 filed May 25, 1999, now abandoned, which application is a continuation-in-part of application Ser. No. 09/152,469, filed Sep. 8, 1998 now abandoned.

ORIGIN OF THE INVENTION

This invention described herein was made under a NASA contract and is subject to the provisions of Public Law 96-517 (35 USC 202) in which the contractor has elected not to retain title.

BACKGROUND OF THE INVENTION

1. Field of the Invention

This invention relates to aluminum alloys, and specifically to high tensile strength aluminum-silicon hypoeutectic and eutectic alloys suitable for high temperature applications such as heavy-duty pistons and other internal combustion applications. It relates particularly to a process for producing a cast article from these high tensile strength aluminum-silicon hypoeutectic and eutectic alloys.

2. Discussions of the Related Art

Aluminum-Silicon (Al—Si) casting alloys are the most versatile of all common foundry cast alloys in the production of pistons for automotive engines. Depending on the Si concentration in weight percent, the Al—Si alloy systems fall into three major categories: hypoeutectic (<12 wt % Si), eutectic (12–13 wt % Si) and hypereutectic (14–25 wt % Si). However, commercial applications for hypereutectic alloys are relatively limited because they are among the most difficult Al alloys to cast and machine due to the high Si contents. When high Si content is alloyed into Al, it adds a large amount of heat capacity that must be removed from the alloy to solidify it during a casting operation. Significant variation in the sizes of the primary Si particles can be found between different regions of the cast article; resulting in a significant variation in the mechanical properties for the cast article. The primary crystals of Si must be refined in order to achieve hardness and good wear resistance. For these reasons, hypereutectic alloys are not very economical to produce because they have a broad solidification range that results in poor castability and requires a special foundry's process to control the high heat of fusion and microstructure. Furthermore, expensive diamond toolings must be used to machine parts, such as pistons, that are made from hypereutectic Al—Si castings. On the other hand, the usage of hypoeutectic and eutectic alloys are very popular for the industry, because they are more economical to produce by casting, simpler to control the cast parameters, and easier to machine than hypereutectic. However, most of them are not suitable for high temperature applications, such as in the automotive field, for the reason that their mechanical properties, such as tensile strength, are not as high as desired in the temperature range of 500° F.–700° F. Current state-of-the-art hypoeutectic and eutectic alloys are intended for applications at temperatures of no higher than about 450° F. Above this elevated service temperature, the major alloy strengthening phases such as the θ' ($Al_2Cu$) and S' ($Al_2CuMg$) will precipitate rapidly, coarsen, or dissolve, and transform themselves into the more stable θ ($Al_2Cu$) and S ($Al_2CuMg$) phases. This undesirable microstructure and phase transformation results in drastically reduced mechanical properties, more particularly the ultimate tensile strength and high cycle fatigue strengths, for hypoeutectic and eutectic Al—Si alloys.

One approach taken by the art is to use ceramic fibers or ceramic particulates to increase the strength of hypoeutectic and eutectic Al—Si alloys. This approach is known as the aluminum Metal Matrix Composites (MMC) technology. For example, R. Bowles has used ceramic fibers to improve tensile strength of a hypoeutectic 332.0 alloy, in a paper entitled, "Metal Matrix Composites Aid Piston Manufacture," *Manufacturing Engineering,* May 1987. Moreover, A. Shakesheff has used ceramic particulate for reinforcing another type of hypoeutectic A359 alloy, as described in "Elevated Temperature Performance of Particulate Reinforced Aluminum Alloys," *Materials Science Forum,* Vol. 217–222, pp. 1133–1138 (1996). In a similar approach, cast aluminum MMC for pistons using eutectic alloy such as the 413.0 type, has been described by P. Rohatgi in a paper entitled, "Cast Aluminum Matrix Composites for Automotive Applications," *Journal of Metals,* April 1991.

Another approach taken by the art is the use of the Ceramic Matrix Composites (CMC) technology in the place of hypoeutectic and eutectic alloys. For example, W. Kowbel has described the use of non-metallic carbon—carbon composites for making pistons to operate at high temperatures in a paper entitled, "Application of Net-Shape Molded Carbon—Carbon Composites in IC Engines," *Journal of Advanced Materials,* July 1996. Unfortunately, the material and processing costs of these MMC and CMC technology approaches are substantially higher than those produced using conventional casting, and they cannot be considered for large usage in mass production, such as engine pistons.

SUMMARY OF THE INVENTION

A primary object of the present invention is to provide a process for making a cast article from an aluminum alloy, which cast article has improved mechanical properties at elevated temperatures.

According to the present invention, an aluminum alloy having the following composition, by weight percent, is first provided:

| | |
|---|---|
| Silicon (Si) | 11.0–14.0 |
| Copper (Cu) | 5.6–8.0 |
| Iron (Fe) | 0–0.8 |
| Magnesium (Mg) | 0.5–1.5 |
| Nickel (Ni) | 0.05–0.9 |
| Manganese (Mn) | 0–1.0 |
| Titanium (Ti) | 0.05–1.2 |
| Zirconium (Zr) | 0.12–1.2 |
| Vanadium (V) | 0.05–1.2 |
| Zinc (Zn) | 0.05–0.9 |
| Strontium (Sr) | 0.001–0.1 |
| Aluminum (Al) | balance |

In this aluminum alloy the ratio of Si:Mg is 10–25, and the ratio of Cu:Mg is 4–15.

An article is cast from this composition, and the cast article is aged at a temperature within the range of 400° F. to 500° F. for a time period within the range of 4 to 16 hours.

In a preferred embodiment, after an article is cast from this alloy, the article is heat treated in a solutionizing step which dissolves unwanted precipitates and reduces any segregation present in the said alloy. After the solutionizing step, the article is quenched, and is then aged at elevated temperature for maximum strength.

BRIEF DESCRIPTION OF THE DRAWING

The Drawing is a chart showing a comparison of an alloy according to the present invention with two well-known hypoeutectic (332.0) and eutectic (413.0) commercial alloys. The chart compares ultimate tensile strengths (tested at 500° F., 600° F. and 700° F.), after exposure of a cast article to a temperature of 500° F., 600° F. and 700° F. for 100 hours, respectively.

DETAILED DESCRIPTION OF THE INVENTION

The alloy employed in the present invention is marked by an ability to perform in cast form at elevated temperature. The aluminum-silicon (Al—Si) alloy employed in the present invention, which is suitable for high temperature applications and which can be used as a hypoeutectic or eutectic Al—Si alloy, is composed of the following elements, by weight percent (wt. %):

| | |
|---|---|
| Silicon (Si) | 11.0–14.0 |
| Copper (Cu) | 5.6–8.0 |
| Iron (Fe) | 0–0.8 |
| Magnesium (Mg) | 0.5–1.5 |
| Nickel (Ni) | 0.05–0.9 |
| Manganese (Mn) | 0–1.0 |
| Titanium (Ti) | 0.05–1.2 |
| Zirconium (Zr) | 0.12–1.2 |
| Vanadium (V) | 0.05–1.2 |
| Zinc (Zn) | 0.05–0.9 |
| Strontium (Sr) | 0.001–0.1 |
| Aluminum (Al) | balance |

In this alloy the ratio of Si:Mg is 10–25, preferably 14–20; and the ratio of Cu:Mg is 4–15.

Iron and manganese may be omitted from the alloy employed in the present invention. However, these elements tend to exist as impurities in most aluminum alloys due to common foundry practices. Eliminating them completely from the alloy (i.e., by alloy refining techniques) will increase the cost of the alloy significantly.

Silicon gives the alloy a high elastic modulus and low thermal expansion when the concentration is greater than 10 wt. %. At a level of 12%–13%, silicon provides excellent surface hardness and wear resistance properties, and the alloy will not require expensive diamond tooling for machining if the silicon concentration is kept well below about 14 wt %. Finally, the addition of silicon also improves the fluidity of the molten aluminum to enhance the castability of the alloy according to the present invention.

Copper co-exists with magnesium and forms a solid solution in the aluminum matrix to give the alloy age-hardening properties, thereby improving the high temperature strength. Copper also forms the θ' phase compound ($Al_2Cu$), and is the most potent strengthening element in this new alloy. The enhanced high strength at high temperatures will be affected if the copper wt % level is not adhered to.

Moreover, the alloy strength can only be maximized effectively by the simultaneous formation for both of the θ' ($Al_2Cu$) and S' ($Al_2CuMg$) metallic compounds, using proper addition of magnesium into the alloy relative to the elements of copper and silicon. Experimentally, it is found that an alloy with a significantly higher level of magnesium will form mostly S' phase with insufficient amount of θ' phase. On the other hand, an alloy with a lower level of magnesium contains mostly θ' phase with insufficient amount of S' phase. To maximize the formation of both the θ' and S' phases, the alloy composition was specifically formulated with copper-to-magnesium ratios ranging from 4 to 15, with a minimum value for magnesium of no less than 0.5 wt %. In addition to the Cu/Mg ratio, the silicon-to-magnesium ratio should be kept in the range of 10 to 25, preferably 14 to 20, to properly form the $Mg_2Si$ intermetallic compound as a minor strengthening phase, in addition to the primary θ' and S' phases.

Titanium and vanadium form primary crystals of Al—Ti and Al—V metallic compounds and these crystallized compounds will act as nuclei for grain size refinement upon the molten alloy being solidified from the casting process. Titanium and vanadium also function as dispersion strengthening agents, in order to improve the high temperature mechanical properties.

Zirconium forms primary crystals of Al—Zr compound. These crystallized intermetallic compounds also act as particles for dispersion strengthening. Zirconium also forms a solid solution in the matrix to a small amount, thus enhancing the formation of GP (Guinier-Preston) zones, which are the Cu—Mg rich regions, and the θ' phase in the Al—Cu—Mg system to improve the age-hardening properties.

Nickel improves the alloy tensile strength at elevated temperatures by reacting with aluminum to form the $Al_3Ni_2$ and $Al_3Ni$ compounds, which are stable metallurgical phases to resist the degradation effects from the long-term exposure to high temperature environments.

Strontium is used to modify the Al—Si eutectic phase. The strength and ductility of hypoeutectic and eutectic are substantially improved with finer grains by using strontium as an Al—Si modifier. Effective modification is achieved at a very low additional level, but the range of recovered strontium of 0.001 to 0.1 wt. % is commonly used.

The alloy employed in this invention is processed using conventional gravity casting in the temperature range of about 1325° F. to 1450° F., without the aid of pressure such as squeeze casting, pressure casting or die-casting, to achieve dramatic improvement in tensile strengths at 500° F. to 700° F. However, it is anticipated that further improvement of tensile strengths will be obtained when the alloy employed in this invention is cast using pressure casting techniques such as squeeze casting or die-casting.

An article, such as an engine block or a piston, is cast from the alloy, and the cast article is then solutionized at a temperature of 900° F. to 1000° F. for fifteen minutes to four hours. The purpose of the solutionizing is to dissolve unwanted precipitates and reduce any segregation present in the alloy. For applications at temperatures from 500° F. to 700° F. the solutioning treatment may not be required.

After solutionizing, the article is advantageously quenched in a quenching medium, at a temperature within the range of 120° F. to 300° F., most preferably 170° F. to 250° F. The most preferred quenching medium is water. After quenching, the article is aged at a temperature of 425° F. to 485° F. for six to 12 hours.

Table 1 below shows ultimate tensile strength, yield strength and fatigue strength at tested temperatures for an article produced according to the process of the present invention, which has been exposed to test temperatures of 500° F., 600° F. and 700° F. for 100 hours. The fatigue test is a push-pull, completely reversed stress cycle, R-1. This is the most severe type of fatigue testing. Table 1 also shows the hardness as measured at room temperature (Rockwell B scale) for an article produced according to the process of the present invention which has been exposed to 500° F., 600° F. and 700° F. for 100 hours.

TABLE 1

| Temperature (° F.) | Ultimate Tensile Strength (ksi) | Yield Strength (ksi) | Fatigue Strength (ksi) at 10 million cycles | Hardness (Rockwell B Scale) |
|---|---|---|---|---|
| 75 | 39 | 34 | 19 | 67 |
| 400 | 32 | 31 | 14 | 61 |
| 500 | 25 | 21 | 11 | 53 |
| 600 | 21 | 18 | 9 | 44 |
| 700 | 15 | 13 | 7 | 31 |

Table 2 below illustrates the dramatic improvement in the ultimate tensile strength at elevated temperatures for an article produced according to the present invention. This table compares the tensile strengths of articles produced according to this invention, with articles prepared from two well known hypoeutectic (332.0) and eutectic (413.0) alloys, after articles cast from these alloy have been exposed to 500° F., 600° F. and 700° F. for 100 hours. Then, the articles were tested at elevated temperatures of 500° F., 600° F. and 700° F., respectively. It is noted that the tensile strength of the article produced according to this invention is more than three times that of conventional eutectic 413.0, and more than four times that of the hypoeutectic 332.0 alloy, when tested at 700° F. Such a dramatic improvement in tensile strength enables the design and production of new pistons to achieve better engine performance, while utilizing less material. By using less material, the piston weight and the production cost are also reduced significantly.

In recent years, increasingly stringent exhaust emission regulations for internal combustion engines have forced piston designers to reduce the piston's crevice volume (the space between the piston top-land and the cylinder bore) by moving the piston ring closer to the top of the piston. Such piston design modifications reduce exhaust emissions, but require a stronger cast alloy to prevent failure of the piston top-land, due to high mechanical cyclic loading at elevated temperatures. Unfortunately, most commercially available pistons are unable to meet a constant demand for higher strength at elevated temperatures of above 500° F. Indeed, the dramatic improvement in strength, provided by articles produced according to the present invention, is a most significant factor that will enable gasoline and diesel pistons to meet exhaust emission standards and to achieve better engine performance.

Articles produced from conventional hypoeutectic and eutectic alloys undergo dimensional changes when they are exposed to high temperature after heat treatment. In most cases, an increase in volume of the cast part is to be found and these volume changes are commonly called thermal growth. It will be noted also that the thermal growth or dimensional stability of articles produced according to this invention is better than that obtained from conventional alloys such as the eutectic 413.0 and hypoeutectic 332.0 alloy at elevated temperatures, when tested under the same operating conditions. Currently, all standard eutectic alloys show the material thermal growth in the piston top-land area, which causes a deformation problem for the piston skirt. Articles produced according to this invention has a significantly less material thermal growth to maintain optimum clearances of both the piston skirt and ring lands to the cylinder wall, thus preventing piston noise and enhancing durability and oil consumption. The lower thermal growth of articles according to this invention is favorable factor for the making of high performance gasoline and diesel pistons.

TABLE 2

| Article | UTS at 500° F. (ksi) | UTS at 600° F. (ksi) | UTS at 700° F. (ksi) |
|---|---|---|---|
| This invention | 25 | 21 | 15 |
| 332 (hypoeutectic) | 13 | 7.5 | 3.5 |
| 413 (eutectic) | 13 | 7 | 4.5 |

We claim:

1. A process for making a cast article from an aluminum alloy, which article has improved mechanical properties at elevated temperatures, the process comprising:

a. Casting an article from an aluminum alloy having the following composition in weight percent:

| | |
|---|---|
| Silicon | 11.0–14.0 |
| Copper | 5.6–8.0 |
| Iron | 0–0.8 |
| Magnesium | 0.5–1.5 |
| Nickel | 0.05–0.9 |
| Manganese | 0–1.0 |
| Titanium | 0.05–1.2 |
| Zirconium | 0.12–1.2 |
| Vanadium | 0.05–1.2 |
| Zinc | 0.05–0.9 |
| Strontium | 0.001–0.1 |
| Aluminum | balance |

Wherein the ratio of silicon:magnesium is 10–25, and the ratio of copper:magnesium is 4–15 b. Aging the cast article at a temperature within the range of 400° F. to 500° F. for a time period within the range of four to 16 hours.

2. The process of claim 1, wherein the cast article is exposed to a solutionizing step prior to the aging step, the solutionizing step being carried out by exposing the cast article to a temperature within the range of 900° F. to 1000° F., for a time period of fifteen minutes to four hours.

3. The process of claim 1, wherein the cast article is aged at a temperature within the range of 425° F. to 485° F. for 6 to 12 hours.

4. The process of claim 1, wherein the alloy contains less than 1.0 weight percent of iron and manganese.

5. The process of claim 2, wherein the solutionizing step is followed by a quenching step, the cast article being quenched in a quenching medium at a temperature within the range of 120° F. to 300° F.

6. The process of claim 5, wherein the temperature of the quenching medium is within the range of 170° F. to 250° F.

7. The process of claim 6, wherein the quenching medium is water.

8. The process of claim 1, wherein the article is cast from the aluminum alloy by gravity casting without the aid of pressure.

* * * * *